United States Patent [19]

Bellagamba

[11] Patent Number: 5,026,065

[45] Date of Patent: Jun. 25, 1991

[54] GOLF TRAINING APPARATUS

[76] Inventor: Miro D. Bellagamba, 5161 Vineland Rd., Orlando, Fla. 32811

[21] Appl. No.: 661,056

[22] Filed: Feb. 25, 1991

[51] Int. Cl.[5] ..... A63B 69/36

[52] U.S. Cl. ..... 273/191 A

[58] Field of Search ..... 273/191 R, 191 A, 191 B, 273/190 R, 192, 183 B, 189 A

[56] References Cited

U.S. PATENT DOCUMENTS 1,567,530 12/1925 MacNaughton et al. ..... 273/191 A
4,852,881 8/1989 Bellagamba ..... 273/191 A

OTHER PUBLICATIONS

Popular Science, Jul. 1982, p. 42.

*Primary Examiner*—Theatrice Brown

*Attorney, Agent, or Firm*—William M. Hobby, III

[57] ABSTRACT

A golf training apparatus has a frame and a golf club swing guide attached to the frame for guiding a person's swing of a golf club. A simplified guide adjustment system allows for basic telescoping frame members to be used in the adjustment of the position of the first golf club swing guide as to both height and tilt of the guide. The frame and swing guides are made of a PVC (or polyethylene) pipe. Adjustments are made by telescoping the frame members and swing guide support members to the desired position and locking them in place. The frame has a single pair of vertical frame members attached to the base and open at the base for inserting over a pair of ground anchor posts to prevent movement of the golf training apparatus during practice swings because of it lightweight.

8 Claims, 2 Drawing Sheets

GOLF TRAINING APPARATUS

BACKGROUND OF THE INVENTION

The present invention relates to a golf training apparatus and especially to a golf training apparatus for guiding the swing of a golf club.

Proper striking of a golf ball requires more than a simple swinging motion of the golf club. Numerous factors come into play, any one of which, if improperly executed can cause a poor golf shot. A proper address of the ball by the player, proper grip of the club, proper body position and proper swing of the golf club are four of the key variables that must be correctly executed to achieve a good shot. If, however, the player properly addresses the ball, properly grips the club and assumes the correct body position, an erroneous shot can still result due to improper swing of the golf club. Further in this regard, if one does not swing the golf club properly, the golfer's head can be forced into movement, the club head can be pulled out of proper alignment with the golf ball, the body can be forced into an incorrect position, and the like. Any one of these errors could spell disaster to the shot. It is therefore, quite essential that the player properly swing the golf club. In fact, a properly swung club can force one to meet other criteria that are necessary for the successful golf shot. The correct swing of the golf club is therefore very important to a successful execution of the golf shot whether off the tee, on the fairway, out of a sand trap, or the like.

The ranks of golf professionals, and low handicap amateurs are said to have "grooved" their swings. This statement, of course, refers to the fact that these individuals have mastered a correct swing of the golf club according to their individual physical makeup, so that swinging of the club in the proper manner is a natural reaction. Hence the proper address is made, the club head is smoothly carried away from the ball in the proper arc, properly brought down into engagement with the ball and guided into a proper follow through after striking the ball. Each of these steps are accompanied by proper body action and reaction. In the "grooved" swing, one continually executes these functions as a natural event with a close degree of accuracy whereby a large majority of shots are consistent and predictable.

Throughout golf history, numerous items have been devised to facilitate education or instruction of a golfer in the art of stance, club grip, body movement, swing of the club and the like. In fact, numerous teaching aids have heretofore been devised for instructing one in the proper swing of a golf club. Such devices provide means to compel the individual to swing the club along a predetermined arc or plane. In general, these devices have utilized varying geometric swing paths for both back swing and follow through. A majority of these devices provide a slide or the like, secured to the apparatus and designed to receive a real or simulated club and follow the particular predetermined swing path. Numerous shaped swing paths have been shown in the prior art.

The present invention teaches a swing of a golf club utilizing a simplified swing training system which can guide a swinging club on a swing path while providing different adjustments for different golfers and incorporates an earth anchor system to keep the lightweight system from moving around.

Typical prior U.S. Patents which are pertinent to the present invention includes the Plunkett et al U.S. Pat. No. 2,520,287 which shows a golf club guiding device which captures a golf club and holds it in position for a spiral like swing. The Zega U.S. Pat. No. 2,653,025 is for a mechanical golf instruction aid which captures the golf club and holds it for a predetermined swing. The Plunkett et al U.S. Pat. No. 2,713,491 is a golf club guiding device for guiding the club in a predetermined manner. The MacStocker U.S. Pat. No. 1,960,787 is for a golf club guiding system directing the club around a predetermined swing. The Sciarrillo U.S. Pat. No. 4,040,633 is a golf swing training machine supported by a base sitting on an angled surface and guides the golf club on a spiraled pipe guide. The U.S. Pat. No. 3,794,329 to Wilson is for a golf teaching apparatus in which the shaft of a golf club is attached to a sleeve which slides on a track to control the swing of a person practicing on the device. The Garland patent teaches an early mechanical golf teaching aid which also slides a shaft in a circular track. In the U.S. Pat. No. 3,744,739 to Hightower a golf practice device has a guiding track for teaching the proper technique for swinging a golf club.

In my prior U.S. Pat. Nos. 4,852,881, dated Aug, 1, 1989, and 4,949,974, dated Aug. 21, 1990, both for GOLF TRAINING DEVICE, a training apparatus was made mostly of PVC pipe and included a first circular golf club guide with means for adjusting for different sized golfers.

SUMMARY OF THE INVENTION

The present invention relates to a golf training apparatus and especially to a golf club swing training apparatus having a frame and a golf club swing guide attached to the frame for guiding a person's swing of a golf club. A simplified guide adjustment system allows for basic telescoping frame members to be used in the adjustment of the position of the first golf club swing guide as to both height and tilt of the guide. The frame and swing guides are made of a PVC (or polyethylene) pipe. Adjustments are made by telescoping the frame members and swing guide support members to the desired position and locking them in place. The frame has a single pair of vertical frame members attached to the base and open at the base for inserting over a pair of ground anchor posts to prevent movement of the golf training apparatus during practice swings because of it light weight.

The frame includes: a pair of base members, a pair of lower swing guide support members, each lower swing guide support member attached to one of the base members and to the swing guide, a pair of vertically extending and collapsing frame members, each vertically extending frame member being attached at one end to one of the base members, a pair of upper swing guide support members slidably attached to the vertically extending frame members at the other end thereof, each of the upper swing guide support members being attached to said the guide; and a cross brace member. The guide adjustment system adjusts the position of the golf club swing guide, and has a height adjustment system for the golf club swing guide including the pair of vertically extending frame members and the lower swing guide support members being telescoping members and having a locking system for locking the telescoping members in a preset position to thereby raise and lower the upper swing guide support members and the swing guide. The angle adjustment system for the golf club swing guide includes the frame base members being telescoping members and the upper swing guide members being slidable on the vertically extending frame members to thereby adjust the angular position of the swing guide. A simplified golf swing training apparatus can thus be adjusted for height and angle to fit a particular golfer.

A person stands in position in the golf training apparatus and swings his club in a backstroke to slide along the golf club guide. The golf club guides can be made of a polymer pipe, such as a polyethylene or PVC, with telescoping frame members for shifting the height and angular position of the arcuate golf club swing guides. Attachments are provided to the frame for a waist stand so that the body is held in position during the swing. The attachment may be eyebolts which also lack the expanded vertically extending frame members in expanded position.

BRIEF DESCRIPTION OF THE DRAWING

Other objects, features and advantages of the present invention will be apparent from the written description and the drawings in which.

DESCRIPTION OF THE PREFERRED EMBODIMENT

Figure 1:
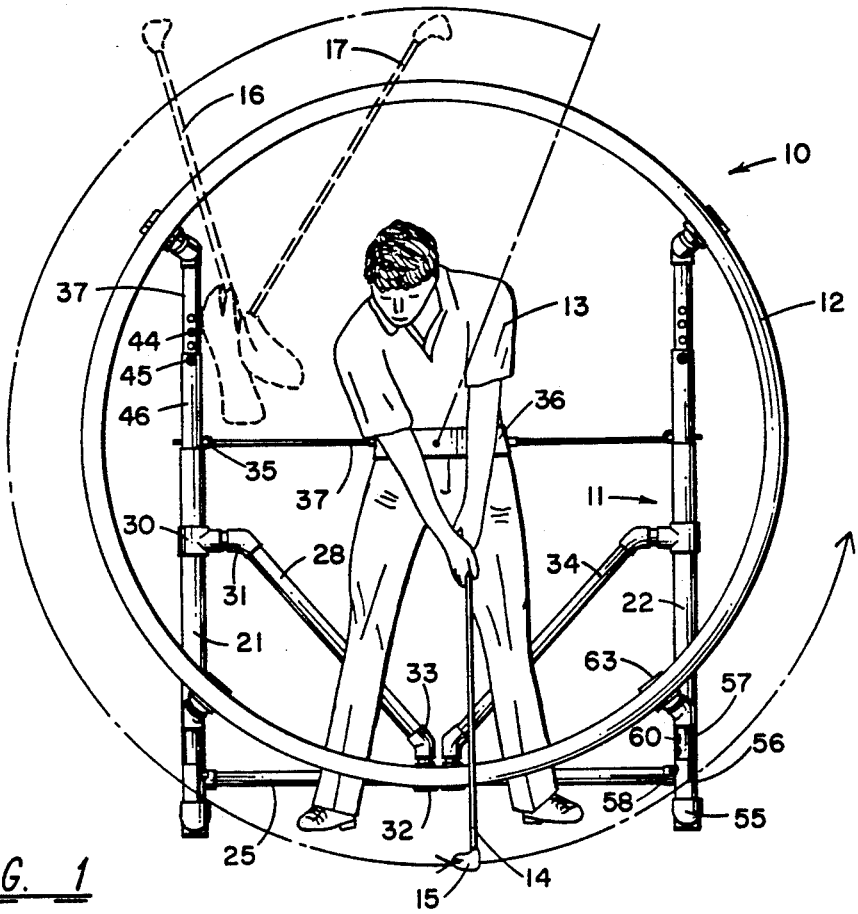
FIG. 1 is a front elevation of a golf training apparatus in accordance with the present invention having a golfer positioned therein.
Figure 2:
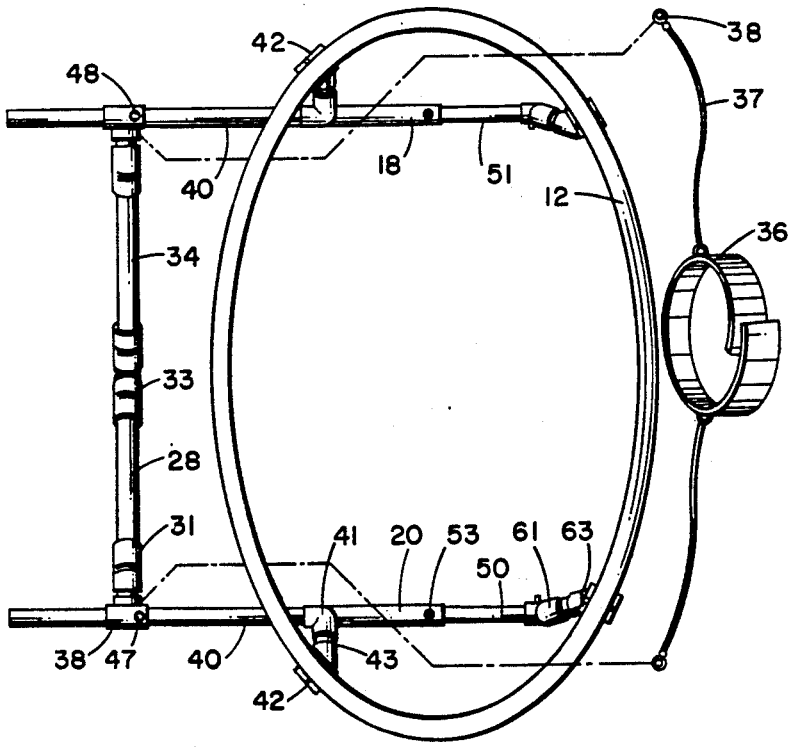
FIG. 2 is a top plan view of the golf training apparatus of FIG. 1.
Figure 3:
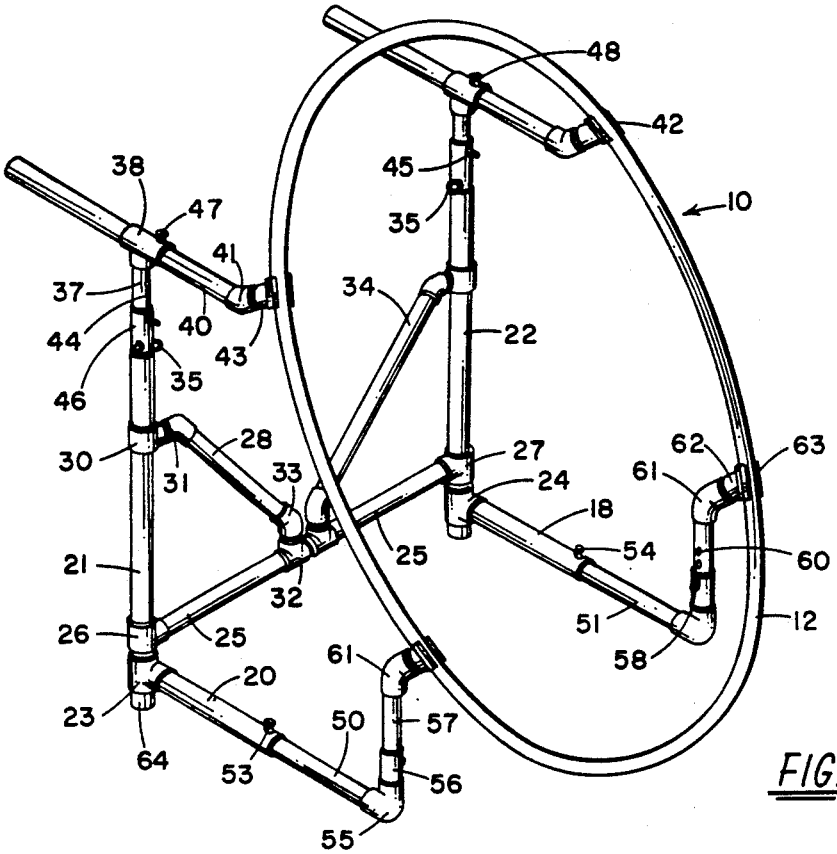
FIG. 3 is a perspective view of the golf training apparatus in accordance with FIGS. 1 and 2.

Referring to the drawings, FIGS. 1–4, a golf training device 10 is illustrated having a frame 11 supporting a golf club swing guide 12 in the form of a circular golf club guide made of a plastic pipe formed into a circle. A golfer 13 is shown in FIG. 1 having a golf club 14 in his hand having a golf club head 15 in the middle of a stroke following the golf club swing guide 12. Phantom views 16 and 17 of the club show a complete backstroke following the swing guide 12 during the stroke of the golfer 13. The frame 11 also acts as the guide adjustment means and is a simplified combination having a pair of base frame members 18 and 20 which can sit on the ground to support the frame and the swing guide 12.

A pair of vertically extending upright frame members 21 and 22 are connected to base frame members 20 and 18, respectively, through a T-coupling 23 and a T-coupling 24. A cross brace member 25 is connected to the vertical frame member 21 with a T-coupling 26 and to the vertical frame member 22 through a T-coupling 27. A pair of upright frame members 21 are further supported by angled brace member 28 attached to the vertical upright 21 with a T-coupling 30 and an L-joint 31 and attached to the cross brace member 25 with a T-coupling 32 and L-coupling 33. The angled brace 34 is attached in the same manner as the brace 28 but to the vertical frame member 22.

A pair of vertical frame member extensions 46 expand and collapse the vertical frame members and are locked in an expanded position by eyebolts 35 attached thereto for attaching a waistband attachment 36 shown on the golfer's 13 waist in FIG. 1. The waistband attachment has a pair of bungee or elastic cords 37 having an end attachment 38 for attaching to the eyebolts 35 in back of the golfer 13. The angle brace members 28 and 34 form a generally V-shape in back of the golfer so that the entire area behind the golfer's back is open to provide him the freedom of movement without bumping any frame members. The vertically extending frame member 21 has a telescoping arm 37 from the expanded portion 46 and has a T-coupling 38 on the end thereof and has an upper swing guide support member 40 sliding in the T-coupling 38. The upper swing guide support member 40 has an elbow 41 on one end along with a swing guide clamp 42 for holding the circular swing guide 12. A short arm 43 connects the elbow 41 in the guide clamp 42.

The telescoping member 37 of the vertically extending frame member 21 has a plurality of holes 44 therein and a lock pin 45 for locking the telescoping arm in place. Similarly, the vertically extending frame member 22 has the same plurality of holes and locking member. The sliding upper swing guide support members 40 has a threaded lock screw 47 in the T-coupling 38 for screwing onto the guide support member 40 through the T-coupling 38. The base member 20 has a telescoping frame member 50 while the base frame member 18 has a telescoping frame member 51. The frame members 50 and 51 have threaded locking screws 53 and 54 for locking the telescoping members 50 and 51 in a desired telescoped position. Telescoping member 50 and 51 have right angle elbows 55 on the end thereof. A lower swing guide support member 56 is attached to each elbow 55 and has a telescoping arm 57 locked with a lock pin 58 through a plurality of openings 60 in the arm 57. Each lower swing guide support member 57 has an elbow 61 at the other end thereof connected to a short arm member 62 which holds the lower swing guide 12 clamps 63.

Thus, the height of the swing guide 12 can be adjusted by telescoping the lower swing guide support members 56 and 57 to a desired position while simultaneously telescoping in or out the vertically extending frame members 21 and 22 and then placing the lock pins 45 and 58 into the respective positions to lock the height of the swing guide 12. The angle of the swing guide 12 can be adjusted by sliding the base telescoping members 18 and 20 members 50 and 51 in and out until a desired position is reached at which time they can be locked with lock screws 53 and 54 while simultaneously sliding the slidable upper swing guide support members 40 in the T-connectors 38 in and out on a generally horizontal plane to any desired position. In addition, the elbows 41 on the upper swing guide support members 40 allows the brace 42 and arm 43 to turn as needed for attaching to the swing guide 12. Similarly, the elbows 55 attach to the telescoping members 50 and 51 and can also rotate as desired and the elbow 61 can allow rotation to adjust the clamps 63 as desired. Thus, the golfer can rapidly adjust the simplified frame and golf club swing guide by telescoping the swing guide in and out on the horizontally extending members and up and down on the vertically extending support members 21 and 22, while simultaneously having some of the elbow couplings able to turn slightly to adjust the clamps. The clamps are made of short sections of PVC pipe having parts removed so that they can be snapped onto the circle guide 12. This allows the circle guide 12 to be changed to a different size as desired and to be able to break the entire system down into a smaller package.

Figure 5:
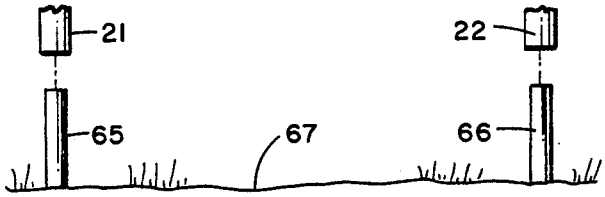
FIG. 5 is a front elevation of a earth anchor attachments for said golf training apparatus of FIGS. 1 through 4.
Figure 4:
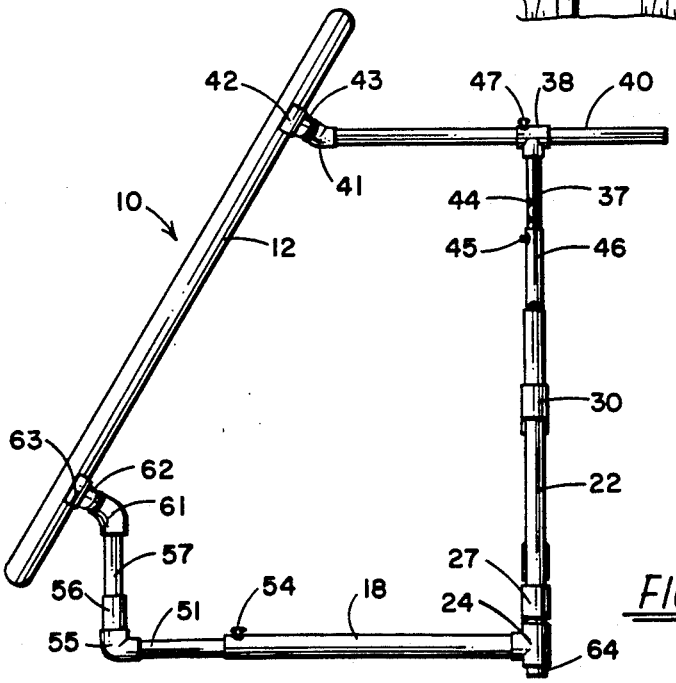
FIG. 4 is a side elevation of the golf training apparatus in accordance FIG. 1 through 3.

The bottom 64 of the vertically extending frame members 21 and 22 have hollow cylindrical openings. Since the frame members 21 and 22 are made of cylindrical hollow pipe, these are left open on the bottom for sitting on the ground but more specifically a pair of matching posts 65 and 66, seen in FIG. 5, can be placed the exact distance between the vertically extending members 21 and 22 and of the exact size and shape to fit in the openings 64. The pipes 64 and 65 are driven or placed into the earth 67 to act as earth anchors for the golf training device 10 and the vertical upright members 21 and 22 bottom opening 64 can be slid over the pipe 65 and 66 thereby anchoring the entire golf training apparatus in position against movement.

Inasmuch as the simplified frame is a lightweight frame it can be easily moved by golfer's swinging along the guide or bumping and thereby continuously shifting the position around. The earth anchors 65 and 66 incorporating with the existing vertical upright members eliminate this problem even though it should be clear that the golf training apparatus 10 can be used with or without the earth anchors. The entire golf swing apparatus is made of heavy PVC pipe or the like which is all cylindrical shaped and coupled together with conventional PVC pipe couplings including T-connectors and right angled elbows as well as other elbows and different size pipes used to form the telescoping members and a single piece of pipe can be formed in a circle to form the circular guide 12. Clamps 42 can be similarly formed by using a conventional T-coupling with a portion removed to make the clamp. Thus, the apparatus is normally simple and inexpensive to manufacture but provides a wide variety of adjustments to accommodate any size golfer and is easily removably anchored to the earth. The extension members 46 extend the vertical extending frame members 21 and 22 and are locked in the expanding position with the eyebolts 35 which also act to hold the elastic cords 37. This allows the system to be collapsed into a smaller package for shipping or storage.

It should be clear at this time that a golf training apparatus has been provided which advantageously allows adjustment of the swing guide for an arcuate path to guide the golf club for different golfers and has a much simplified frame and multiple adjustment system and incorporates an earth anchor in the system to maintain the lightweight system in constant position. However, the present invention is not to be limited to the forms shown which are to be considered illustrative rather than restrictive.

I claim:

1. A golf training apparatus comprising:

a frame;

a golf club swing guide attached to said frame, said golf club swing guide for guiding a person's swing;

said frame including:

a pair of base members;

a pair of lower swing guide support members, each lower swing guide support member attached to one said base member and to said swing guide;

a pair of vertically extending frame members, each vertically extending frame member being attached at one end to one said base member;

a pair of upper swing guide support members slidably attached to said vertically extending frame members at the other end thereof, each said upper swing guide support member being attached to said swing guide; and a cross brace member;

guide adjustment means for adjusting the position of said golf club swing guide, said guide adjustment means having height adjustment means for said golf club swing guide including said pair of vertically extending frame members and said lower swing guide support members being telescoping members and having means for locking said telescoping members in a preset position to thereby raise and lower said upper swing guide support members and said swing guide; and angle adjustment means for said golf club swing guide including said frame base members being telescoping members and said upper swing guide members being slidable on said vertically extending frame members to thereby adjust the angular position of said swing guide; whereby a simplified golf swing training apparatus can be adjusted for height and angle to fit a particular golfer.

2. A golf training apparatus in accordance with claim 1 in which said golf club swing guide vertically extending members have open ends adjacent said frame base members and said golf training apparatus includes a pair of posts positioned in the ground and positioned for inserting said open end of said vertically extending members thereunto for holding said golf training apparatus in place.

3. A golf training apparatus in accordance with claim 2 including a waist band attachment attached to said frame and having a removable waist band.

4. The golf training apparatus in accordance with claim 3 in which said frame includes a pair angular brace members, each angular brace member being attached between one said vertically extending frame member and said cross brace member whereby said vertically extending frame members are braced from a single cross brace member.

5. A golf training apparatus in accordance with claim 4 in which said waist band attachment has a pair of elastic cords attached to said vertical extending members.

6. A golf training apparatus in accordance with claim 5 in which said means for locking said telescoping members includes threaded locking bolts.

7. A golf training apparatus in accordance with claim 6 in which said frame vertically extending members each has an expansion section attached in an expanded position by eyebolts which eyebolts have said elastic cords attached thereto.

8. A golf training apparatus in accordance with claim 7 in which each said upper swing guide support member has slide locking means for locking said upper swing guide support member in a predetermined position on one said vertically extending frame member.

* * * * *